US006676435B2

(12) United States Patent
Momiyama

(10) Patent No.: US 6,676,435 B2
(45) Date of Patent: Jan. 13, 2004

(54) PULLOUT PREVENTION STRUCTURE AND CABINET STAND

(75) Inventor: Hiroaki Momiyama, Kanagawa (JP)

(73) Assignee: Sony Computer Entertainment Inc., Tokyo (JP)

( * ) Notice: Subject to any disclaimer, the term of this patent is extended or adjusted under 35 U.S.C. 154(b) by 0 days.

(21) Appl. No.: 10/093,366

(22) Filed: Mar. 7, 2002

(65) Prior Publication Data

US 2002/0127902 A1 Sep. 12, 2002

(30) Foreign Application Priority Data

Mar. 8, 2001 (JP) ..... 2001-065711

(51) Int. Cl.[7] ..... H01R 13/62
(52) U.S. Cl. ..... 439/372; 439/373
(58) Field of Search ..... 439/372, 373, 439/345, 347, 350, 357

(56) References Cited

U.S. PATENT DOCUMENTS 1,989,823 A * 2/1935 Raabe ..... 439/370
2,266,560 A * 12/1941 Mansfield ..... 439/368
2,659,059 A * 11/1953 Johnson ..... 439/373
2,675,530 A * 4/1954 Sadasky ..... 439/365
4,061,407 A * 12/1977 Snow ..... 439/35
4,109,095 A * 8/1978 Kling et al. ..... 174/67

* cited by examiner

*Primary Examiner*—Hien Vu
(74) *Attorney, Agent, or Firm*—Katten Muchin Zavis Rosenman

(57) ABSTRACT

An object of the invention is to provide a structure for preventing easy pullout of a plug that has been inserted into the socket of a device main body, to make the user aware that plug pullout prevention is important, and to fully exhibit the functions of the device.

A cabinet stand according to the present invention is constituted to have rectangular opening 100 which is provided in the middle of rear surface 32*a* of stand main body 32, and a first projection 102 which is provided near opening 100 on the bottom of stand main body 32 and around which power line 16 is wound. The cabinet stand further comprises intermediate member 104 extending from first projection 102 into opening 100 to partition opening 100; two tabs 106 extending horizontally from the opposite side of the lower end of first projection 102 from opening 100; and a second projection 108 being near first projection 102 on the bottom of stand main body 32 so that the second projection may contact power line 16 wound around first projection 102.

9 Claims, 12 Drawing Sheets

PULLOUT PREVENTION STRUCTURE AND CABINET STAND

FIELD OF THE INVENTION

This invention relates to a pullout prevention structure for an insertion member inserted into the insertion hole of a given object, and a cabinet stand for supporting a cabinet that has a socket into which a plug connected to a power line is inserted.

BACKGROUND OF THE INVENTION

In general, in devices of various types, such as personal computers, their external memory devices, and audiovisual equipments, for example, as shown in FIG. 1, signal cable 202 for exchanging signals with the parent machine such as a personal computer, is connected through a connector (not shown) on the rear surface 200*a* of device main body 200. Also provided on this rear surface 200*a* is power terminal 204 for supplying electric power to the device.

Normally, power terminal 204 has socket 210 for receiving plug 208 which is connected to power line 206 (including a power line from an AC adaptor). And by inserting plug 208 into socket 210 on device main body 200, power is supplied to device main body 200 from, for example, an AC adaptor.

Heretofore, when plug 208 is inserted into socket 210, plug 208 is held only by frictional force at its contact point to a spring member (such as leaf spring) in socket 210. Therefore, if plug 208 or power cable 206 were pulled, plug 208 would be easily pulled out of socket 210 of device main body 200.

In such a device, there has been the problem that when the power is accidentally interrupted during operation, it is difficult thereafter to restore the device to normal operation.

SUMMARY OF THE INVENTION

In view of such problems, it is an object of the present invention to provide a pullout prevention structure being configured such that a plug inserted into a socket of a device main body cannot easily be pulled out, and also provide a cabinet stand having such structure.

A further object of this invention is to provide a pullout prevention structure and a cabinet stand having such structure, the structure being configured such that a plug inserted into a socket of a device main body cannot be pulled out easily, thereby to make the user aware that preventing of plug pullout is important, and allow device functions to be fully exhibited.

In one aspect of the invention, there is provided a structure for preventing the pullout of an insertion member inserted into an insertion hole of an object, comprising: a shaft member whose axis is at a position different from the insertion position of said insertion member; and an engagement member being rotatable about said shaft member, being biased toward the location of said insertion member, and being engageable with said insertion member. The engagement member is typically a hook member.

For inserting the insertion member into the insertion hole, for example, firstly an external force is applied to the hook member so that the hook member rotates in a direction going away from the location of the insertion member, and then the insertion member is inserted into the insertion hole. By releasing said external force, the biased hook member is driven toward the insertion member to engage with the insertion member.

In this state, if the insertion member is accidentally pulled by an unexpected force, the insertion member will not easily be pulled out from the insertion hole, provided that the shaft member is biased by a structure that is not displaced in the pulling direction or it is biased in the insertion direction of the insertion member.

Now note that the term "object" used herein is a concept that includes various devices such as the external memories for personal computers, audiovisual equipments, and so on, and assemblies of one of these devices and stands to be attached to the bottoms of said devices. Also, the insertion member may be provided with a groove into which part of the hook member is inserted.

Also, in such a structure, both of the biasing force in the insertion direction of the shaft member and the force of biasing said hook member toward the location of the insertion member may be supplied by a single spring. This can reduce the number of parts and simplify the structure.

The shaft member may have a guide part for determining the distance that the hook member is to be withdrawn from its rest position for engaging with the insertion member. In this case, the guide part of the shaft member may be formed in a first cross-sectional shape over a length that corresponds to said determined distance, and the part other than said guide part may be formed in a second cross-sectional shape, and an opening conforming said first cross-sectional shape may be formed in the part of said object through which said shaft member is inserted. Also, the second cross-sectional shape may be circular, and the first cross-sectional shape may be a noncircular shape that is larger than said second cross-sectional shape.

In this way, the user will be able to recognize how far the hook member is to be withdrawn, and operation for pullout prevention can be promoted and simplified.

In another aspect of the invention, there is provided a pullout prevention structure of an insertion member inserted into an insertion hole of an object: comprising an insertion member having a cord-shaped member, and a first projection on the outer surface of this object, wherein the cord-shaped member is wound around the first projection.

In operation, first, the insertion member is inserted into the insertion hole of the object. Then the cord-shaped member is wound around the first projection, which is provided on the lower part of the object. In this case, even if the cord-shaped member is accidentally pulled by an unexpected external force, the pulling force will be dispersed in the winding portion around the first projection. Thus, the pulling force does not reach as far as the insertion member, and pullout of the insertion member is effectively prevented.

In particular, according to this invention, the appearance is improved because the wound cord-shaped member around the first projection can be concealed. And because pullout prevention can be done simply, the operation of pullout prevention by the user can be encouraged.

In another aspect of the invention, there is provided a pullout prevention structure of an insertion member inserted into an insertion hole of an object, wherein the insertion member has a cord-shaped member, a first projection is provided on the lower part of said object, the cord-shaped member being wound around the first projection, and wherein an opening, through which said cord-shaped member is inserted, is provided in the lower part of said object at a position near said first projection.

In operation, first, the insertion member is inserted into the insertion hole of the object. Then, the cord-shaped member is passed through the opening in the lower part of the object, and then the member is wound around the first projection on the lower part of the object. As a result, the cord-shaped member wound around the first projection is sandwiched in between the edge of the opening and the first projection, whereby pullout prevention is assured.

Also, a second projection may be provided on the lower part of the object at a position near the first projection and on the opposite side of the first projection from the opening. Thus, the portion of the cord-shaped member that tends to be loosely wound around and thus to fall off from the first projection is firmly held by means of the second projection, whereby secure winding of the cord-shaped member around first projection can be made.

The engagement part may be formed in a generally ring shape that partially supports the rear end of the insertion member, and it may have a shape which is cut at a portion thereof. In this case, the engagement part itself is elastically deformed, and then, as compared with the construction in which the holder piece itself is elastically deformed, the holder piece can be given strength, and even if the mass of the insertion member is made large, the insertion member can be securely held on the latch part by the holder piece.

In another aspect of the invention, there is provided a cabinet stand for supporting a cabinet that has a socket into which a plug connected to a power line is inserted, comprising: a stand main body on which the cabinet is mounted and anchored; and a pullout prevention mechanism that is provided on the stand main body for preventing pullout of a plug inserted into a socket of said cabinet; wherein said pullout prevention mechanism comprises a shaft member extending through an opening which is formed in the surface of said stand main body opposite to the insertion direction of said plug, and a hook member being rotatable about said shaft member, being biased toward the location of the plug, and selectively engaging with said plug.

In operation, for inserting the plug into the insertion hole, for example, first an external force is applied to the hook member so that the hook member rotates in a direction going away from the location of the plug, and then the plug is inserted into the insertion hole. By releasing said external force, the biased hook member is driven toward the plug to engage with the plug.

In this event, even if the power line or plug itself is accidentally pulled by an unexpected force, the plug will not easily be pulled out from the socket, provided that the shaft member is biased by structure that is not displaced in the pulling direction, or it is biased in the insertion direction of the plug.

In another aspect of the invention, there is provided a cabinet stand for supporting a cabinet that has a socket into which a plug connected to a power line is inserted, comprising: a stand main body on which said cabinet is mounted and anchored; and a pullout prevention mechanism that is provided on said stand main body for preventing pullout of a plug inserted into a socket of said cabinet; wherein said pullout prevention mechanism has an opening that is provided in the surface of said stand main body opposite to the insertion direction of said plug and through which said power line is extending, and a first projection that is provided on the bottom of said stand main body and around which said power line is wound.

In operation, first, the plug is inserted into the socket of the cabinet. Then, the power line is passed through the opening in the bottom of the stand main body, and then wound around the first projection on the bottom of the stand main body. As a result, the power line wound around the first projection is sandwiched in between the edge of the opening and the first projection, whereby pullout prevention is assured.

In particular, this invention has an advantage that the appearance is improved because the wound power line around the first projection can be concealed. And, because pullout prevention can be done simply, the operation of pullout prevention by the user can be encouraged.

DESCRIPTION OF PREFERRED EMBODIMENTS

Referring to FIGS. 2–13, a pullout prevention structure and cabinet stand in accordance with one embodiment of this invention are applied for pullout prevention of a plug (for example, a plug connected to a power line from an AC adaptor) inserted into the power terminal of various electronic equipment such as a personal computer, its external memory, or audiovisual equipment.

Figure 1:
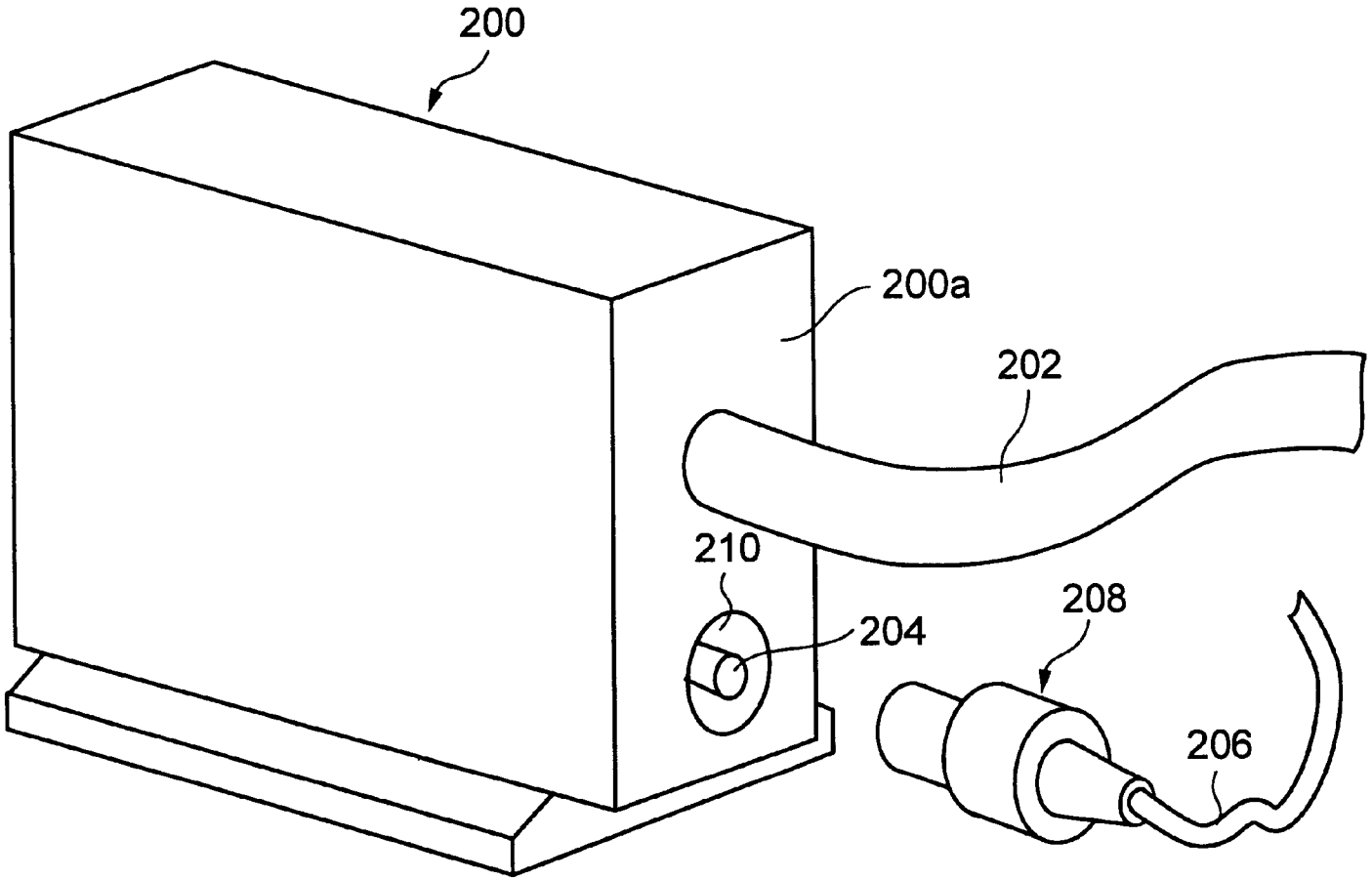
FIG. 1 illustrates insertion of a plug into a socket on a cabinet.
Figure 2:
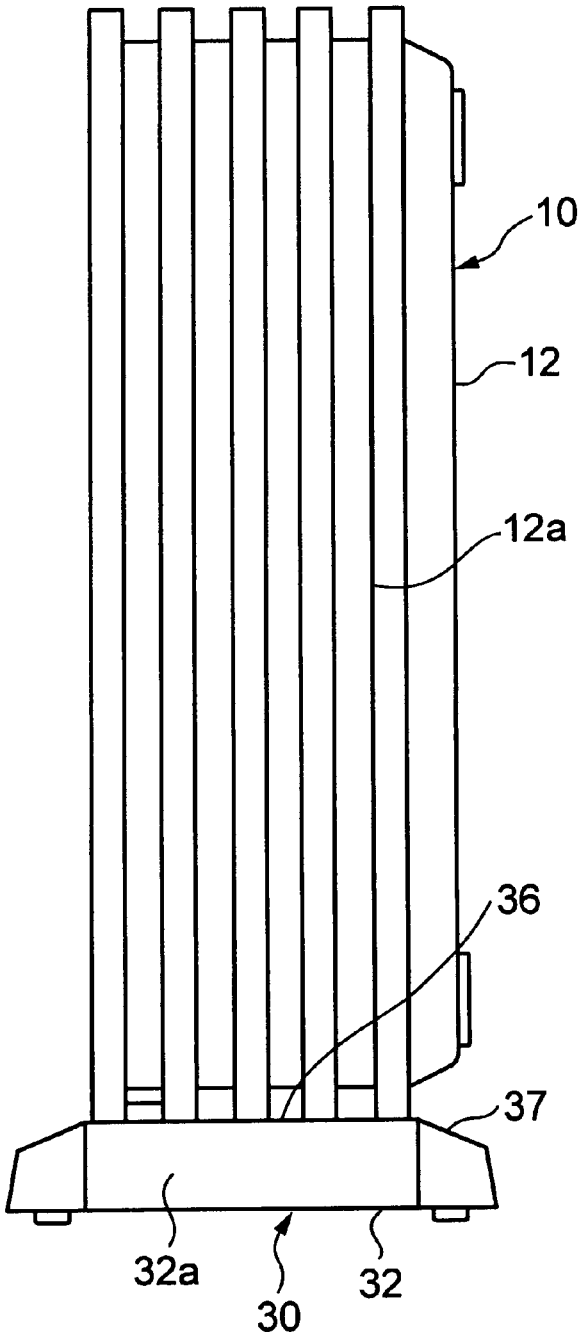
FIG. 2 is a front view of a stand that the present invention may be utilized, together with a cabinet.
Figure 3:
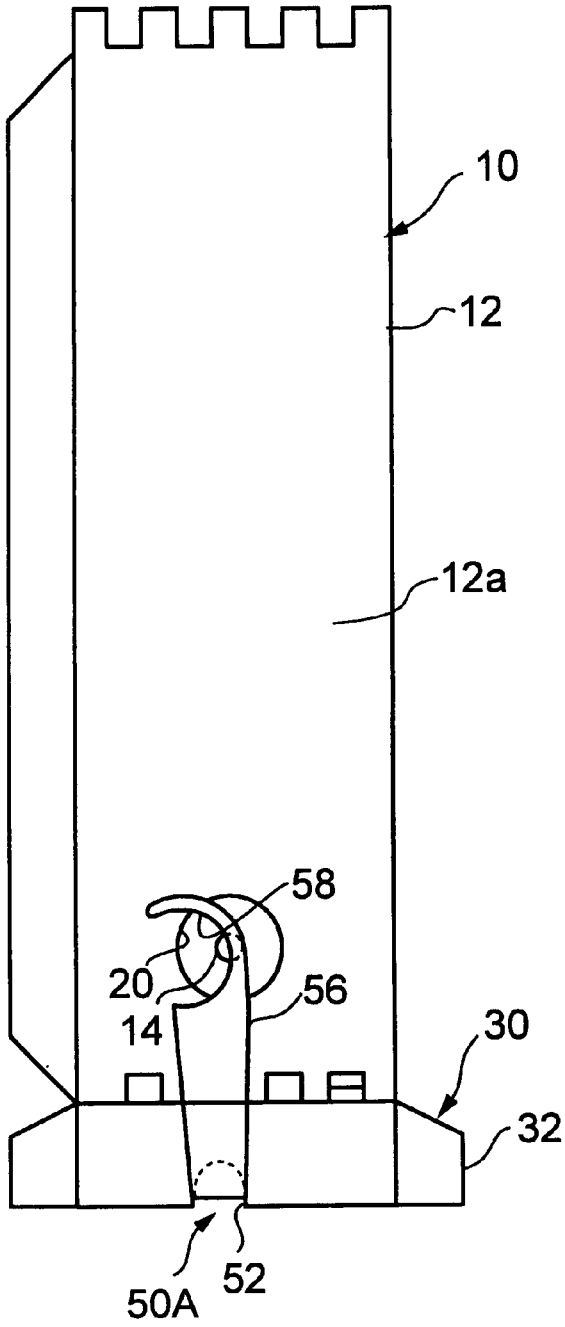
FIG. 3 is a rear view of a stand to which a pullout prevention mechanism according to a first embodiment is attached thereto, together with a cabinet.

As shown in FIG. 2, electronic device 10 preferably comprises its electronic device main body enclosed by cabinet 12. As shown in FIG. 3, electronic device 10 has, for example, power terminal 14 for supplying electric power to the device on its rear side 12*a*. This power terminal 14 has socket 20 (see FIG. 3) for receiving plug 18 (see FIG. 5) connected to power line 16 (including the power line from the AC adaptor). By inserting plug 18 into socket 20 of cabinet 12, power is supplied to electronic device 10 from, for example, the AC adaptor.

Figure 5:
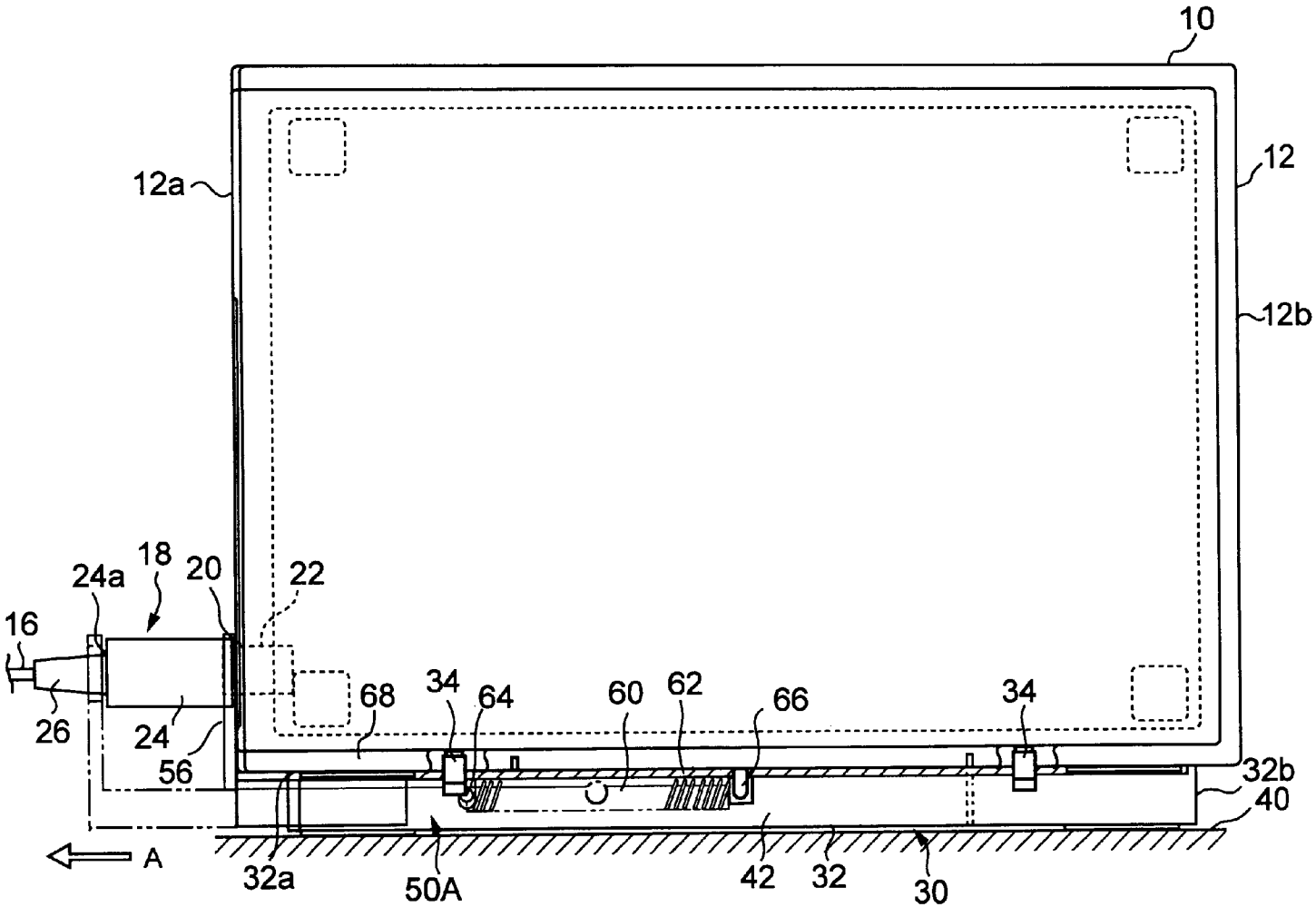
FIG. 5 is a side view, partly cut away, of the stand to which the pullout prevention mechanism according to the first embodiment is attached thereto, together with a cabinet.

As shown in FIG. 5, plug 18 comprises metal terminal part 22 that is connected to a power terminal (see FIG. 3) of socket 20 at its tip; finger-grip part 24 that is positioned behind terminal part 22 and is grasped by a person's fingers; and protection part 26 that is provided integrally behind finger-grip part 24 and is for preventing bending of the base part of power line 16. The maximum outside diameter of protection part 26 is set smaller than the outside diameter of finger-grip part 24. In other words, a ring-shaped flat surface 24*a* is formed at the rear end of finger-grip part 24.

Figure 6:
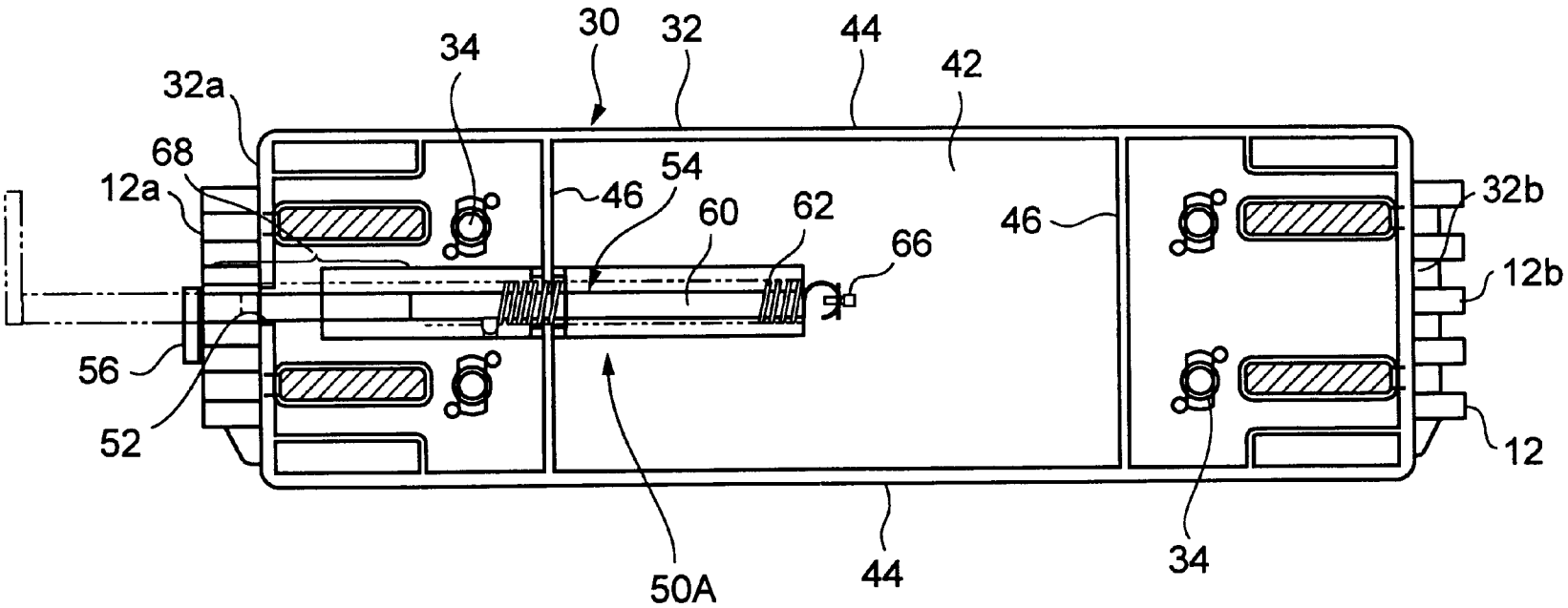
FIG. 6 is a bottom view of the stand to which the pullout prevention mechanism according to the first embodiment is attached thereto, together with a cabinet.

Elsewhere, as shown in FIG. 2, stand 30, onto which cabinet 12 is anchored, comprises stand main body 32 and attachment fixtures 34 for attaching stand main body 32 to the cabinet (see FIGS. 5 and 6). Attachment fixtures 34 are, for example, screws or other means. Stand main body 32 has cabinet mounting part 36, whose top surface is flat, its both sides have tapered surface 37, which slants downward toward the outside, and as shown in FIG. 5, space 42 is defined between the bottom of cabinet mounting part 36 and installation surface 40 (i.e., the surface on which, for example, stand 30 is installed, such as the top surface of a desk, etc.). Multiple reinforcing plates 46 (see FIG. 6) are provided integrally between a pair of side walls 44 along the lengthwise direction of stand main body 32, and are constituted so as to prevent cabinet mounting part 36 from falling into said space 42.

The one surface of cabinet 12, on which socket 20 is provided, is defined as rear surface 12*a* (see FIG. 2), and the surface opposite to rear surface 12*a* is defined as front surface 12*b*. Similarly, among the surfaces of stand main body 32, the surface having the same orientation as rear surface 12*a* of cabinet 12 is defined as rear surface 32*a*, and the surface opposite to rear surface 32*a* is defined as front surface 32*b*.

(First Embodiment)

Figure 7:
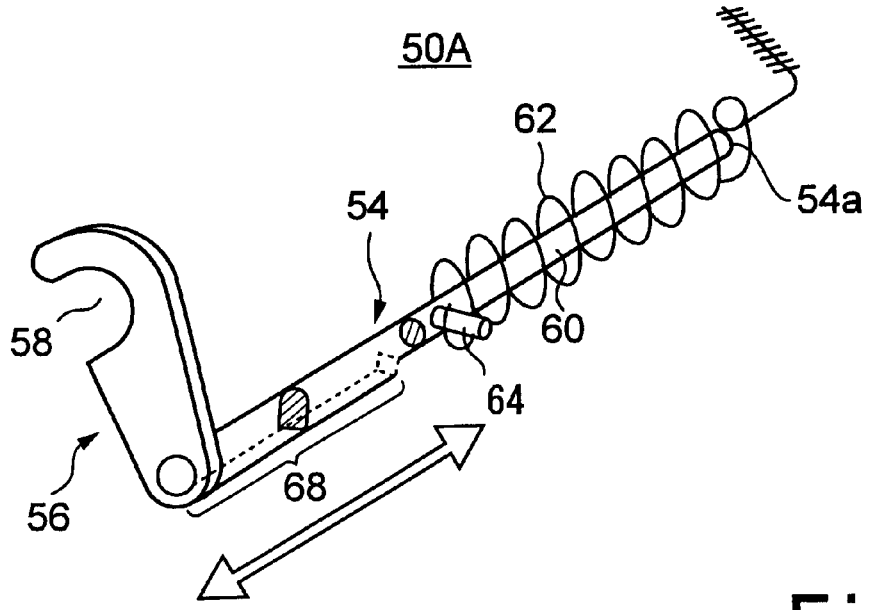
FIG. 7 is a perspective view of the pullout prevention mechanism according to the first embodiment.

As shown in FIGS. 5–7, pullout prevention mechanism 50A according to the first embodiment comprises shaft member 54, which is inserted through opening 52 (see FIGS. 3 through 7) provided in the surface (rear surface 32*a*) of stand main body 32 that is opposite to the insertion direction of plug 18; and hook member 56 being rotatable about shaft member 54, being biased toward the location of plug 18, and being engageable with plug 18. Shaft member 54 is accommodated in space 42 defined within the bottom of stand main unit 32, a portion of the member freely advances and retracts through opening 52, and hook member 56 is in a state that is always exposed from stand 30.

Formed at the tip of hook member 56 is roughly semicircular notch 58, and the diameter of notch 58 is made to be roughly the same as the inside diameter of ring-shaped flat surface 24*a* at the rear end of finger-grip part 24 in plug 18.

Also, hook member 56 has a size and length such that when hook member 56 is pulled out and rotated about shaft member 54, notch 58 of hook member 56 engages with the rear end of finger-grip part 24.

Elsewhere, as shown in FIG. 7, rear half 60 of shaft member 54 is inserted into tension coil spring 62. One end of this tension coil spring 62 is attached to projection 64 on shaft member 54, and its other end is attached to projection 66 (see FIGS. 5 and 6) provided behind rear end 54*a* of shaft member 54 on the bottom of stand main body 32. In other words, shaft member 54 is biased by coil spring 62 toward rear surface 32*b* of stand main body 32, thereby to make hook member 56 abut to rear surface 12*a* of cabinet 12. In this case, it is desirable to dispose hook member 56 on shaft member 54 in such a positional relationship that a portion of socket 20 is hidden behind hook member 56, as shown in FIG. 3.

Also, as shown in FIG. 7, shaft member 54 has a noncircular cross-sectional shape over a prescribed range from the attachment position of hook member 56. In this example, it has such a shape that a semicircular cross-section is joined to a rectangular cross-section. In other words, it is made into a cylinder of U-shaped cross-section over the prescribed range from the attachment position of hook member 56. This part functions as rotation restriction part 68 of the shaft member, as described below.

The part of shaft member 54 other than rotation restriction part 68 is a cylinder of circular cross-section, and its diameter is set to be smaller than the diameter of the part of U-shaped cross section.

And as shown in FIG. 3, opening 52 formed in rear surface 32*a* of stand main body 32 is formed in a U-shape so as to conform to the outside contour of rotation restriction part 68 in shaft member 54. Therefore, in pulling shaft member 54 out of stand main body 32, rotation of rotation restriction part 68 and hence the shaft member (about the axis) is restricted or inhibited by U-shaped opening 52 of stand main body 32 until the U-shaped cross-section part, i.e. rotation restriction part 68 is fully pulled out.

Figure 4:
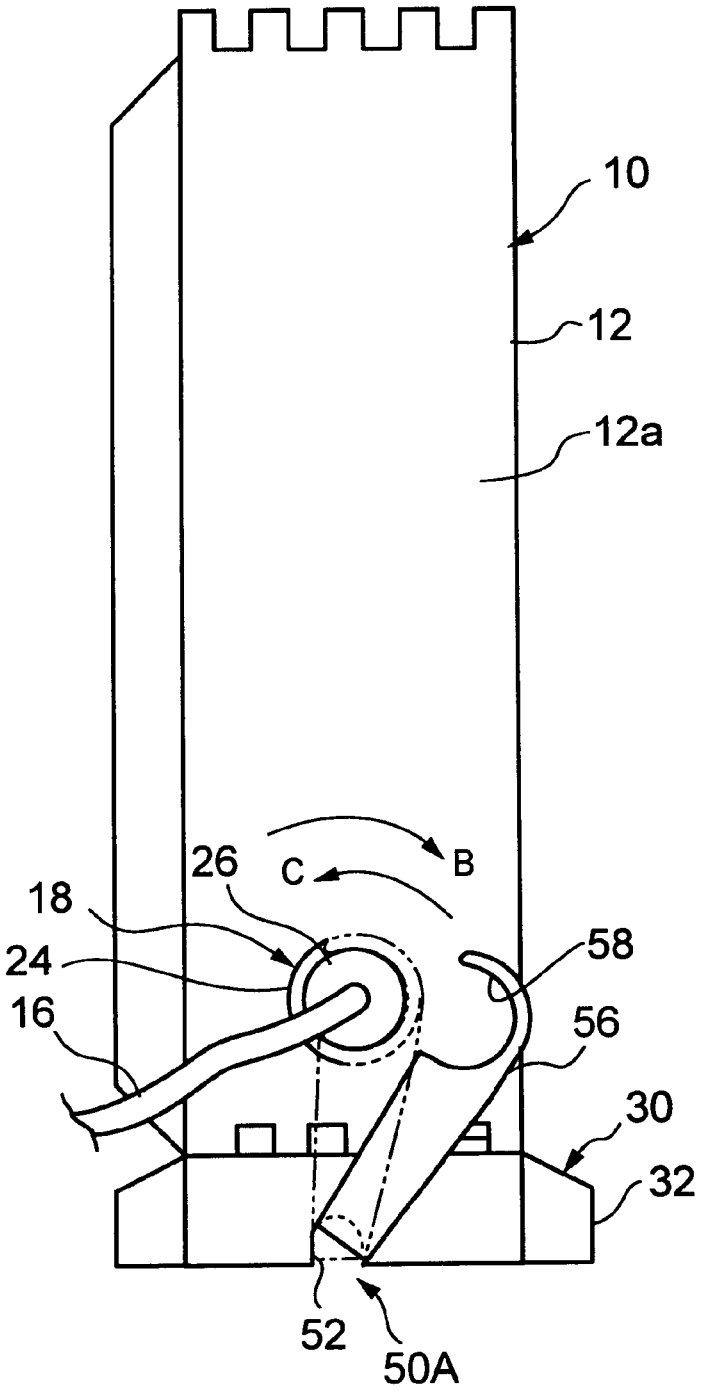
FIG. 4 illustrates the operation of the pullout prevention mechanism according to the first embodiment.

When shaft member 54 is further pulled beyond full length of rotation restriction part 68, the circular cross-section part of shaft member 54 comes to the location opening 52, and therefore shaft member 54 is released from restriction due to U-shaped opening 52, thereby to be allowed to freely rotate about the axis, as shown in FIG. 4.

If the operation of pulling out shaft member 54 is interrupted, the biasing force of coil spring 62 causes shaft member 54 to return to its rest position, i.e. to a position where hook member 56 is in contact with the rear surface 12*a* of cabinet 12.

The length of rotation restriction part 68 of shaft member 54 is set such that rotation restriction part 68 is fully pulled out from rear surface 32*a* of stand main body 32 when hook member 56 reaches the rear end of finger-grip part 24 of plug 18 at the inserted position into socket 20 of cabinet 12. As a result, hook member 56 can be securely latched onto the rear end of finger-grip part 24 of plug 18.

Next, the operation of pullout prevention mechanism 50A according to this first embodiment will be described. First, cabinet 12 is placed in the prescribed position of stand main body 32, anchored with, for example, screws or other attachment fixtures 34. When this is done, as shown in FIG. 3, hook member 56 is positioned in front of socket 20 and conceals a portion of socket 20, so that plug 18 can not be inserted.

Then, hook member 56 is pulled along the axis of shaft member 54 in a direction, as shown by arrow A in FIG. 5, to separate the hook member from rear surface 12*a* of cabinet 12. This pullout operation is continued until rotation restriction part 68 of shaft member 54 is fully pulled out, where hook member 56 can be rotated about the axis of shaft member 54.

Then, hook member 56 is manually driven to rotate against the biasing force of coil spring 62, for example clockwise, as shown by arrow B in FIG. 4, so that plug 18 can be inserted into socket 20. Then, plug 18 is inserted into socket 20, and next, the external force imposed on hook member 56 is released to allow the biasing force of coil spring 62 to causes counterclockwise rotation of hook member 56 as shown by arrow C in FIG. 4, whereby notch 58 of hook member 56 comes into contact with a portion of protection part 26 of plug 18. At this stage, the circumference part of notch 58 of hook member 56 is in contact with rear end surface 24*a* of finger-grip part 24 of plug 18, and therefore hook member 56 is in engagement with plug 18.

In this state, even if plug 18 or power cable 16 is accidentally pulled by an unexpected external force, since shaft member 54 is biased by coil spring 62 in the opposite direction against the pull-out direction, plug 18 will not easily come out from socket 20.

Thus, in pullout prevention mechanism 50A according to the first embodiment and stand 30 that has pullout prevention mechanism 50A, the inserted plug 18 in socket 20 will not easily come out, thereby making it possible to avoid unexpected states caused by a sudden power interruption.

In particular, in this first embodiment, because a single coil spring 62 provides the force of biasing shaft member 54 toward front surface 32*b* of stand main body 32 and also the force of biasing hook member 56 toward plug 18, the number of parts can be reduced, and a simplified structure can be realized. Moreover, the appearance is improved because a portion of pullout prevention mechanism 50A, for example, shaft member 54 or coil spring 62, is arranged so as to be concealed and accommodated inside space 42 below stand main body 32.

Further, because rotation restriction part 68 is provided on shaft member 54, the user can easily recognize how far hook member 56 is pulled out, and therefore can encourage and simplify the pullout prevention operation.

Also, in the initial state, because hook member 56 is positioned in front of socket 20 and plug 18 cannot be inserted, the user can be made aware that it is important to keep plug 18 from being pulled out, and the device functions can be fully exhibited.

(Modification of First Embodiment)

Next, referring to FIG. 7, one example of pullout prevention mechanism 50A according to modification of the first embodiment will be described.

Figure 8:
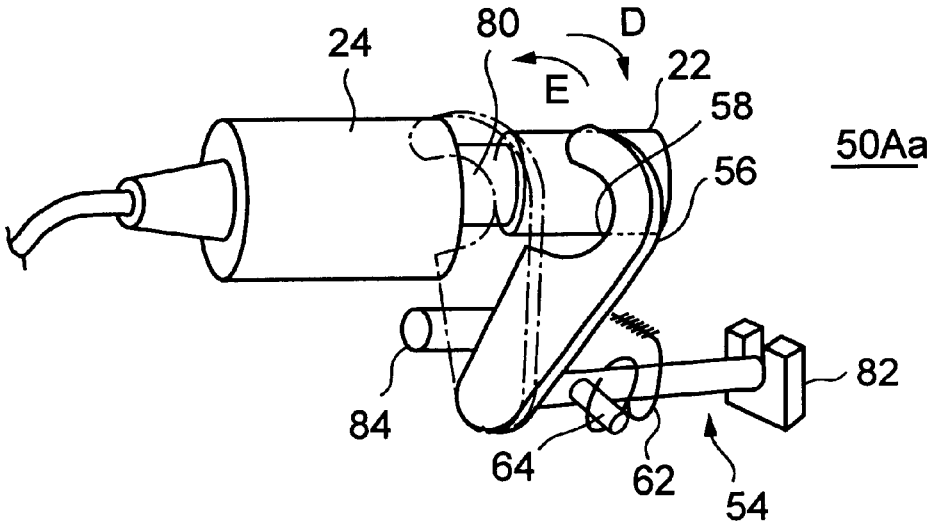
FIG. 8 is a perspective view of a modification of the pullout prevention mechanism according to a modification of the first embodiment.

As shown in FIG. 8, pullout prevention mechanism 50Aa of this modified example has generally same arrangement as the above-described pullout prevention mechanism 50A, except that groove 80 is formed in the portion of plug 18 between terminal part 22 and finger-grip part 24, and that shaft member 54 is attached rotatably to stand main body 32 (not shown in FIG. 8) by bearing member 82. In particular, movement of shaft member 54 in the axial direction is restricted by bearing member 82.

In this modified example, one end of coil spring 62 is anchored to projection 64 of shaft member 54, and its other end is anchored to, for example, sidewall 44 of stand main body 32, so that hook member 56 is biased only in the counterclockwise direction. In this example, stopper 84 is provided to limit the range of rotation of hook member 56 in the counterclockwise direction.

In operation of pullout prevention mechanism 50Aa of this modified example, first, hook member 56 is manually driven to rotate in the clockwise direction against the biasing force of coil spring 62 as shown by arrow D in FIG. 8, thereby to exposes socket 20 entirely, and then plug 18 is inserted into socket 20. After that, the external force being applied to hook member 56 is released. As a result, the biasing force of coil spring 62 causes hook member 56 to rotate in the counterclockwise direction, whereby notch 58 of hook member 56 engages with groove 80 of plug 18 (as drawn with dotted lines).

In this state, if an attempt of pullout of plug 18 is made, the circumference part of notch 58 of hook member 56 contacts to the sidewall of groove 80 of plug 18 to provide resistance against the pulling, whereby pullout of plug 18 from socket 20 is effectively prevented.

In particular, in this modified example, the length of shaft member 54 can be made short, which saves space for the installation space for pullout prevention mechanism 50Aa.

(Second Embodiment)

Next, referring to FIG. 9, pullout prevention mechanism 50B according to a second embodiment of the invention will be described.

Figure 9:
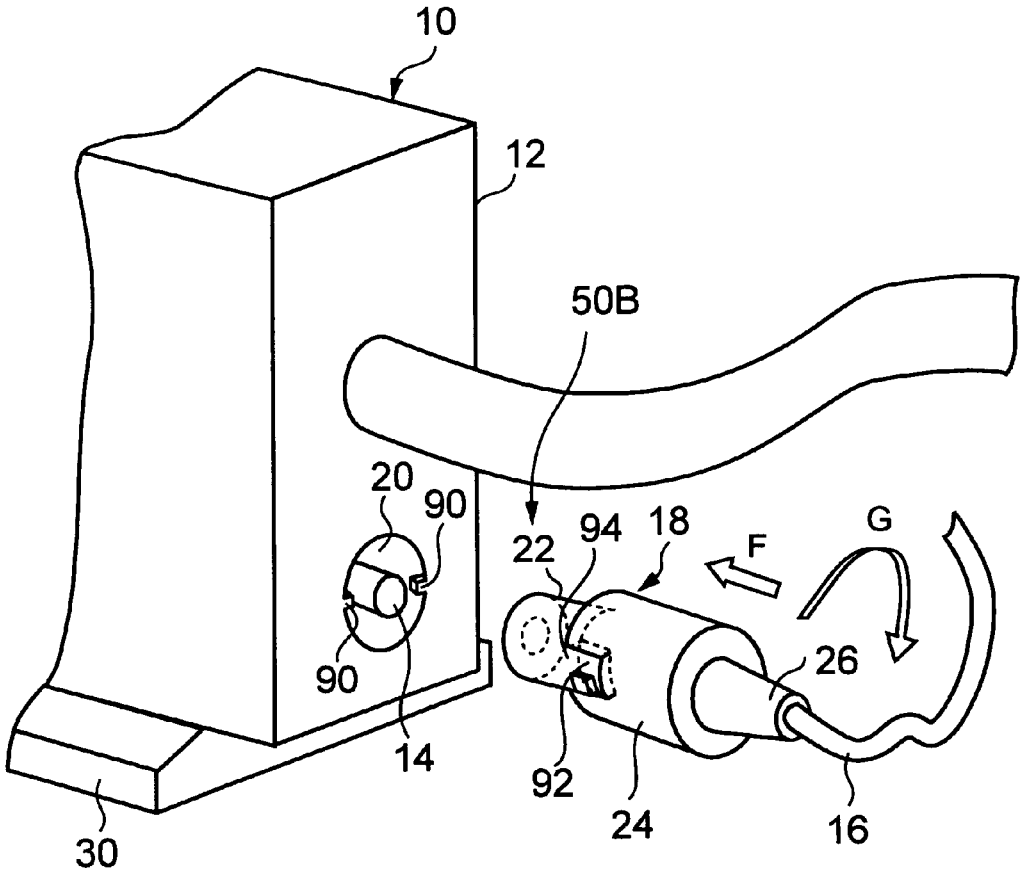
FIG. 9 is a perspective view, partly omitted, of a cabinet and a pullout prevention mechanism according to a second embodiment.

As shown in FIG. 9, pullout prevention mechanism 50B according to this second embodiment is constituted so as to include two tabs 90 inwardly projecting from the inside circumference of socket 20 and, and grooves 92 which are formed in the circumference of plug 18 and through which tabs 90 are inserted.

Tabs 90 are provided at mutually opposite positions on the inside circumference of socket 20. Grooves 92 are provided in plug 18 at two locations corresponding to the two tabs 90. Each groove 92 has an opening 94 in the front end of finger-grip part 24, and groove 92 is shaped so as to extend straight at the front half along the axis of plug 18 toward the back of plug 18 and then extend approximately at a right angle and along the circumference of plug 18. That is, each groove 92 is formed in a roughly L shape.

In operation, for inserting plug 18 into socket 20, first, plug 18 is positioned such that tabs 90 on the side of socket 20 align with grooves 92 of plug 18. From this state, plug 18 is inserted into socket 20 as shown by arrow F in FIG. 9, and then rotated in the opposite direction from the bending direction of grooves 92, as shown by arrow G. And then, by pulling plug 18, tabs 90 come into contact with the sidewalls of grooves 92, so that plug 18 can not easily be pulled out from socket 20.

In particular, because two tabs 90 are provided in mutually opposite positions on socket 20, the structure for preventing pullout of plug 18 can be simplified. Moreover, because grooves 92 are formed in a L-shape, plug 18 will not come out from socket 20 as long as plug 18 is not forced to rotate in the bending direction of the grooves, and therefore reliable pullout prevention can be achieved. In addition, when it is desired, plug 18 can be pulled out easily, by performing the reverse operation of the insertion procedure described above.

(Third Embodiment)

Figure 10:
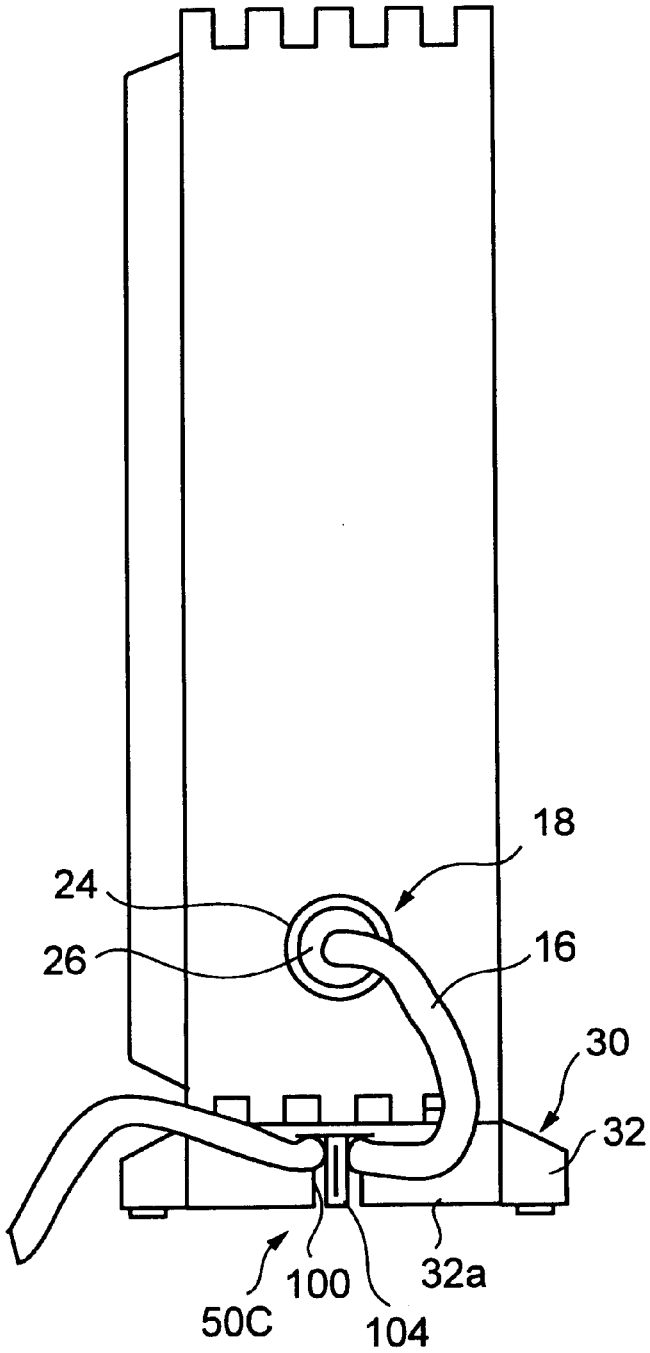
FIG. 10 is a rear view of a stand to which a pullout prevention mechanism according to a third embodiment is attached, together with a cabinet.
Figure 11:
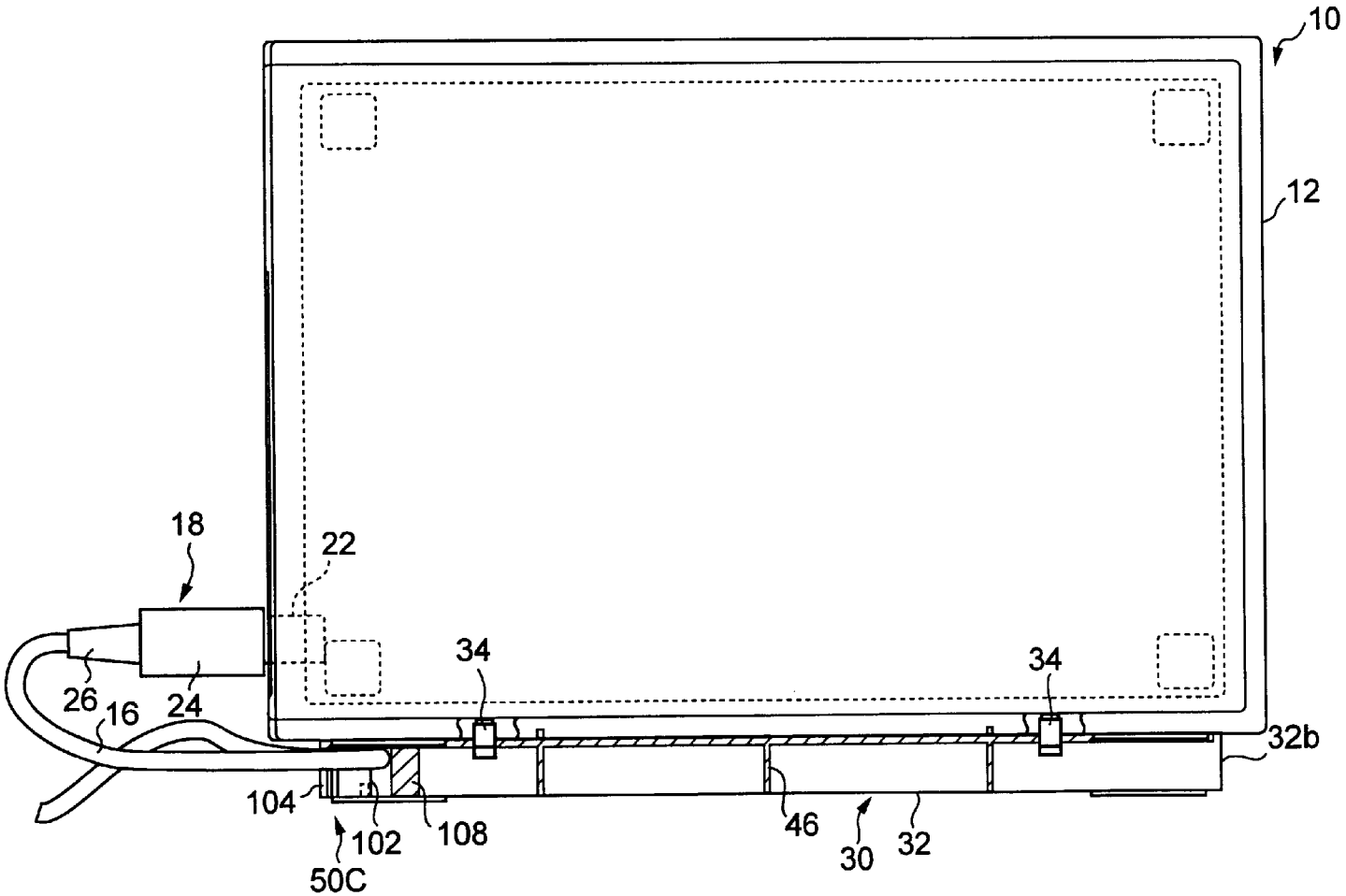
FIG. 11 is a side view of the stand to which the pullout prevention mechanism according to the third embodiment is attached thereto, together with a cabinet.
Figure 12:
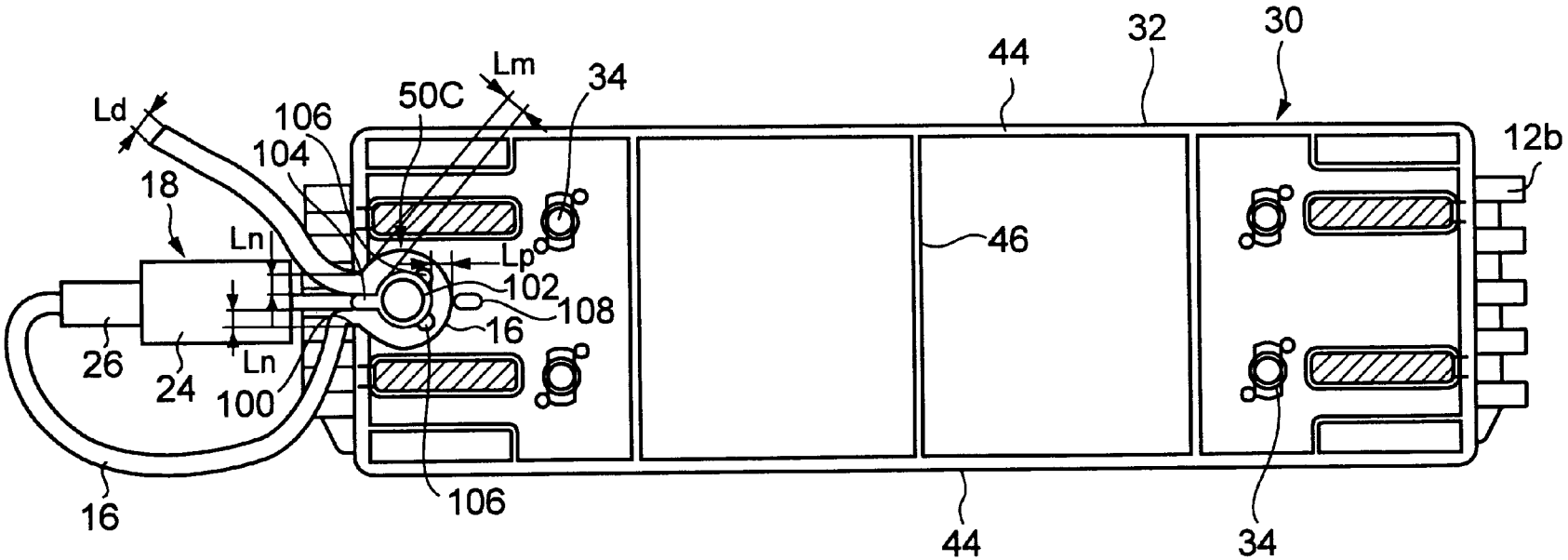
FIG. 12 is a bottom view of the stand to which the pullout prevention mechanism according to the third embodiment is attached thereto, together with a cabinet.

Referring to FIGS. 10–12, pullout prevention mechanism 50C according to a third embodiment of the invention will be described herein below.

As shown in FIG. 10, pullout prevention mechanism SOC according to the third embodiment is constituted so as to have rectangular opening 100 in the middle of rear surface 32*a* of stand main body 32, as shown in FIGS. 11 and 12, and a first projection 102 on the bottom of stand main body 32 and near opening 100 for winding power line 16 around it.

Denoting by Ld the diameter of power line 16 and by Lm the shortest distance between the edge of opening 100 and first projection 102, they are set so as to satisfy the relationship $Lm \leqq Ld$. Also, in this third embodiment, intermediate member 104 extends from first projection 102 into opening 100 to partition opening 100, and denoting by Ln the shortest distance between the edge of opening 100 and intermediate member 104, they are set so as to satisfy the relationship $Ln \leqq Td$.

Moreover, two tabs 106 extend horizontally from the opposite side of the lower end of first projection 102 from opening 100, and a second projection 108 is provided on the bottom of stand main body 32 near first projection 102 so that the second projection may contact power line 16 wound around first projection 102. In this case, denoting by Lp the shortest distance between first projection 102 and second projection 108, they are set so as to satisfy the relationship $Lp \leqq Ld$.

In operation of pullout prevention mechanism 50C, first, plug 18 is inserted into socket 20 of cabinet 12. Then, power line 16 is put through opening 100 in rear surface 32*a* of stand main body 32 so as to be wound around first projection 102 on the bottom of stand main body 32. As a result, power line 16 wound around first projection 102 is sandwiched in between the edge of opening 100 and first projection 102, whereby pullout prevention is assured.

In particular, in this third embodiment, the appearance is improved because the wound power line 16 around first projection 102 can be concealed behind stand main body 32. And, because pullout prevention can be done simply, the operation of pullout prevention by the user can be encouraged.

In particular, in this third embodiment, because the shortest distance Lm between the edge of opening 100 and first projection 102 and diameter Ld of power line 16 are related to each other such that $Lm \leqq Ld$, power line 16 wound around first projection 102 can be firmly sandwiched in between the edge of opening 100 and first projection 102.

Also, because the shortest distance Ln between the edge of opening 100 and intermediate member 104 and diameter Ld of power line 16 are related to each other such that $Ln \leqq Ld$, the portion of power line 16 running from plug 18 to first projection 102 is firmly sandwiched in by the edge of opening 100, first projection 102 and one surface of intermediate member 104, and also the portion of power line 16 running from first projection 102 to the outside is firmly sandwiched in by the edge of opening 100, first projection 102 and the other surface of intermediate member 104, whereby the pullout prevention of plug 18 is further assured.

Further, because two tabs 106 are provided on first projection 102, power line 16 wound around first projection 102 is prevented from falling off from first projection 102, whereby secure winding of power line 16 around first projection 102 can be made.

And also, because second projection 108 is provided, the portion of power line 16 that tends to be loosely wound around and thus to fall off from the first projection is firmly held by the second projection, whereby secure winding of power line 16 around first projection 102 can be made.

(Fourth Embodiment)

Figure 13:
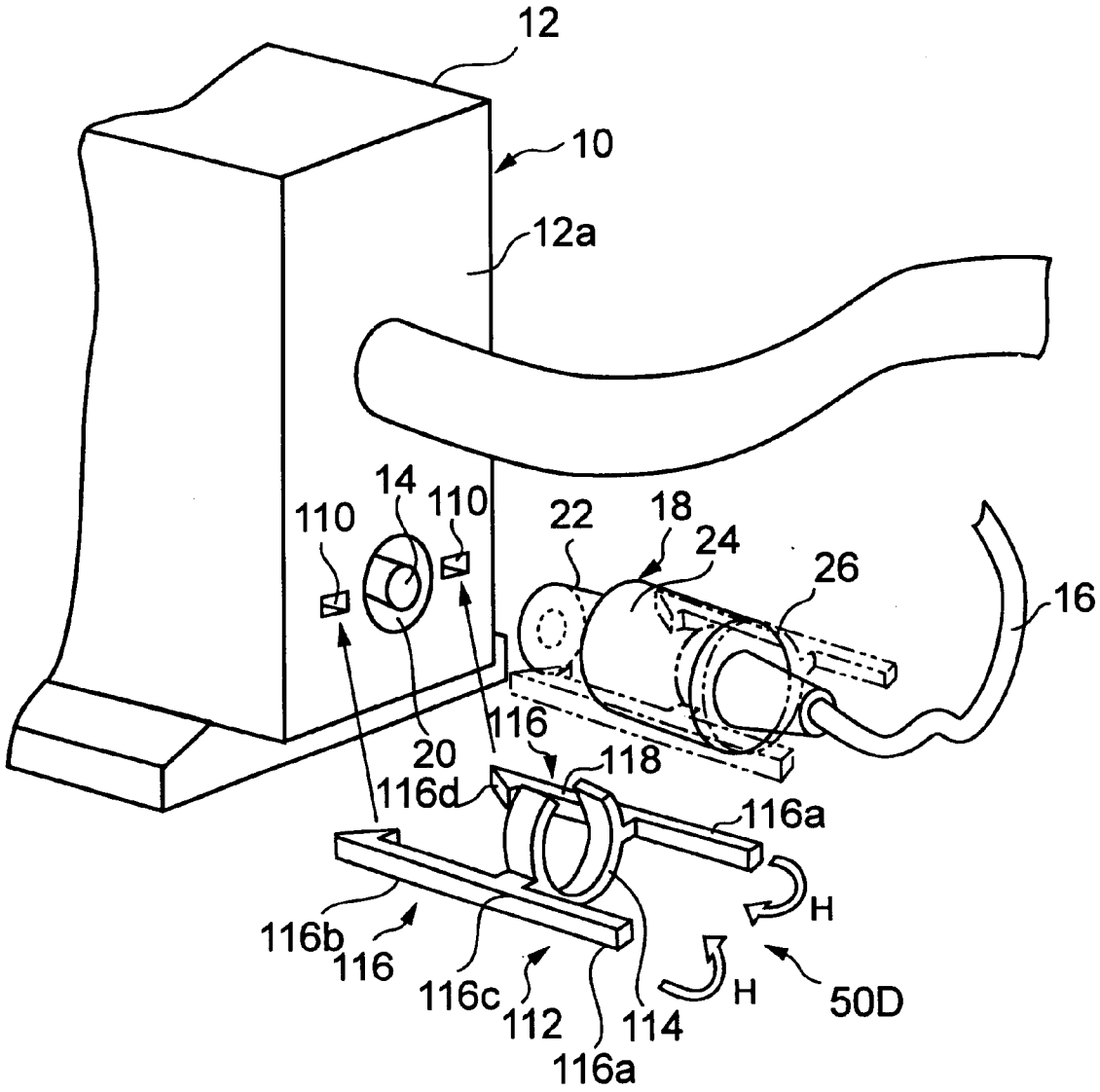
FIG. 13 is a perspective view, partly omitted, of a cabinet and a pullout prevention mechanism of a fourth embodiment.

Referring to FIG. 13, pullout prevention mechanism 50D according to a fourth embodiment of the invention will be described herein below.

As shown in FIG. 13, pullout prevention mechanism 50D is constituted so as to have two insertion holes 110 near socket 20 in rear surface 12*a* of cabinet 12, and latch member 112 including a portion that is elastically latched in insertion holes 110. The latch member engages with plug 18.

Latch member 112 is made of, for example, synthetic resin, and includes engagement part 114 for engaging with the rear end of finger-grip part 24 of plug 18, and two holder pieces 116 integrally formed with engagement part 114 and extending from both sides of engagement part 114 along the insertion direction of plug 18.

Engagement part 114 is formed in a ring-like shape for abutting against the rear end face of finger-grip part 24 of plug 18. Also, this engagement part 114 has opening 118 that is formed by cutting off a portion of a ring member. This opening 118 is shaped so as to make engagement part 114 itself elastic.

Each holder piece 116 comprised a part extending backward from engagement part 114 (hereafter called simply "backward part 116*a*") and a part extending forward from engagement part 114 (hereafter called simply "forward part 116*b*"). The forward and backward parts are integrally formed as a continuous piece, and are also integrally formed with engagement part 114 though connection part 116*c*.

Tip portion 116*d* of forward part 116*b* is tapered inwardly and rearward so as to form a so-called arrow shape.

In operation, when an external force is applied inwardly, as shown by H in FIG. 13, from the outer surface of backward parts 116*a* of holder pieces 116, the opposite portion of engagement part 114 from opening 118 is elastically deformed, whereby forward parts 116*b* of holder pieces 116 are displaced so as to separate away from each other.

When the external force on backward parts 116*a* is released, then, said portion of engagement part 114 is elastically restored to bring forward parts 116*b* of holder pieces 116 to a positional relationship of being roughly parallel to one another.

Elsewhere, insertion holes 110 in cabinet 12 are sized so as to allow tip portions 116*d* of holder pieces to be inserted therein, and the shortest distance between insertion holes 110 is set to be approximately the same as the distance between holder pieces 116, in particular, the distance between the parts excluding tip 116*d*.

Therefore, when plug 18 is to be inserted into socket 20, first the rear end face of finger-grip part 24 of plug 18 is engaged with engagement part 114 of latch member 112, and then the tips of holder pieces 116 of latch member 112 are inserted into insertion holes 110 of cabinet 12, simultaneously with insertion of plug 18 into socket 20 of cabinet 12.

At this time, by grasping backward parts 116*a* of holder pieces 116, as shown by arrows H, the tips 116*d* of holder pieces 116 move away from each other, so that tips 116*d* of holder pieces 116 can be readily inserted into insertion holes 110. After insertion, when the external force on backward parts 116*a* of holder pieces 116 is released, holder pieces 116 become roughly parallel to one another, and the inward projections of tips 116*d* are latched inside insertion holes 110.

Of course, in inserting the state that holder pieces 116 of latch member 112 into insertion holes 110, tips 116*d* of holder pieces 116 can be inserted into insertion holes 110 without inward force being exerted on backward parts 116*a* of holder pieces 116. In this case, it is just needed to forcedly push holder pieces 116 into insertion holes 110 after bring the tapered surface of tips 116*d* of holder pieces 116 into contact with the edge of insertion holes 110. When holder pieces 116 are pushed in, tips 116*d* of holder pieces 116 move away from each other because of the inclination of the taper surface on tip portions 116*d*, and then tips 116*d* are inserted into insertion holes 110. At the stage in which tips 116*d* are completely inserted, tips 116*d* are elastically restored and are held inside insertion holes 110.

Holder pieces 116 can be easily removed by grasping backward parts 116*a* of holder pieces 116 to separate tip portions 116*d* of holder pieces 116 from contact to the insertion holes, and then pulling out latch member 112.

In pullout prevention mechanism 50D according to this fourth embodiment, since engagement part 114 itself is elastically deformed, holder pieces 116 can be given strength, as compared with the structure in which holder pieces 116 themselves are elastically deformed, and thus even if the mass of plug 18 is large, the latched state of holder pieces 116 in insertion holes 110 can be made secure.

In particular, if the width of the opening of engagement part 114 is made smaller than diameter D of power cable 16, then even if plug 18 is pulled out from socket 20 of cabinet 12, latch member 112 will not fall off from power cable 16, so plug 18 and latch member 112 can be handled as one unit, and pullout prevention of plug 18 by the user can be actively encouraged.

Also, if the inside diameter of engagement part 114 is made roughly the same as the diameter of protection part 26 of plug 18, it becomes difficult for latch member 112 to get loose from plug 18, so the integrated handling of plug 18 and latch member 112 can be made more secure.

However, the pullout prevention structure and cabinet stand according to this invention are not limited to the above embodiments, and various constructions may be adopted without departing from the gist of this invention.

The pullout prevention structure and cabinet stand according to this invention is configured so that, for example, a plug inserted into the socket of a device main body cannot easily be pulled out.

Moreover, according to this invention, there are provided structures in which, for example, it is not easy to pull out a plug that has been inserted into the socket of a device main body, the user can be made aware that plug pullout prevention is important, and the operation of the device can be fully exhibited.

EXPLANATION OF THE SYMBOLS

10: electronic device
12: cabinet
16: power line
18: plug
20: socket
30: stand
32: stand main body
50A, 50Aa, 50B, 50C, 50D: pullout prevention mechanisms
52: opening
54: shaft member
56: hook member
62: tension coil spring
64: projection
68: rotation restriction part
90: tabs
92: grooves
100: opening
102: first projection
104: intermediate member
106: tab
108: second projection
110: insertion holes
112: latch member
114: engagement part
116: holderpiece

What is claimed is:

1. A pullout prevention structure of an electrical plug inserted into an insertion hole of an electrical device, comprising:

a shaft member attached to the electrical device and having an axis at a position different from an insertion position of said electrical plug, and an engagement member being rotatable about said shaft member, being spring-biased toward the location of said electrical plug and being engageable with said electrical plug, wherein said shaft member is spring-biased in the direction of insertion of said electrical plug.

2. A pullout prevention structure as described in claim 1, wherein the spring-biasing of said shaft member in the direction of insertion and the spring-biasing of said engagement member toward said electrical plug are provided by a single spring.

3. A pullout prevention structure as described in claim 1 or 2, wherein said shaft member further comprises a part serving as a guide to determine a distance over that the engagement member is to be pulled out from a position at which it rests to engage with the electrical plug.

4. A pullout prevention structure as described in claim 3, wherein said guide serving part of said shaft member has a first cross-sectional shape over a length corresponding to said pullout distance of said engagement member, while a remaining part other than said guide serving part has a second cross-sectional shape, and said object has an opening through which said shaft member is inserted, said opening having a shape conforming said first cross-sectional shape.

5. A pullout prevention structure as described in claim 4, wherein said second cross-sectional shape is circular and said first cross-sectional shape is noncircular and is larger than the size of said second cross-sectional shape.

6. A pullout prevention structure as described in claim 1, wherein said shaft member is slidably attached to said object.

7. An electrical cabinet stand for supporting a cabinet that has a socket into which a plug connected to a power line is inserted, comprising:

a stand main body for mounting and anchoring a cabinet thereon, and a pullout prevention mechanism provided on said stand main body that prevents pullout of the plug inserted into the socket of a cabinet, said pullout prevention mechanism further comprising:

a shaft member that is inserted through an opening provided in a surface of said stand main body opposed to the direction of insertion of said plug, and a hook member that is connected to said shaft member and being rotatable about said shaft member, is spring biased toward the location of said plug and is selectively engageable with said plug, wherein said shaft member is spring biased in the direction of insertion of said plug.

8. A cabinet stand as described in claim 7, wherein said shaft member is slidably attached to said stand main body.

9. A cabinet stand as described in claim 7, wherein the hook member and the shaft member are biased by a single spring.

* * * * *